United States Patent [19]

Schneider

[11] Patent Number: 4,644,720

[45] Date of Patent: Feb. 24, 1987

[54] HARDWOOD FLOORING SYSTEM

[76] Inventor: Raymond H. Schneider, 1525 Eastmoor Rd., Burlingame, Calif. 94010

[21] Appl. No.: 667,094

[22] Filed: Nov. 1, 1984

[51] Int. Cl.[4] ..... E04F 15/02; E04B 5/00

[52] U.S. Cl. ..... 52/392; 52/403; 52/743

[58] Field of Search ..... 52/392–394, 52/403, 480, 592, 743, 744, 309.4, 309.5, 309.13

[56] References Cited

U.S. PATENT DOCUMENTS

| | | | |
|---|---|---|---|
| Re. 26,239 | 7/1967 | Rockabrand et al. | 52/480 X |
| 1,890,954 | 12/1932 | Snyder | 52/393 |
| 2,114,450 | 4/1938 | Maclean | 52/394 |
| 2,253,943 | 8/1941 | Rice | 52/592 X |
| 2,862,255 | 12/1958 | Nelson | 52/480 X |
| 3,209,502 | 10/1965 | Donegan | 52/394 |
| 3,449,879 | 6/1969 | Bloom | 52/744 X |
| 3,518,800 | 7/1970 | Tank | 52/480 |
| 3,713,264 | 1/1973 | Morgan | 52/480 X |
| 4,162,597 | 7/1979 | Kelly | 52/592 X |
| 4,292,776 | 10/1981 | MacDonald | 52/403 X |
| 4,449,342 | 5/1984 | Abendroth | 52/480 X |
| 4,453,366 | 6/1984 | Piccagli | 52/744 X |
| 4,470,236 | 9/1984 | MacDonald | 52/394 |
| 4,486,994 | 12/1984 | Fisher et al. | 52/744 X |

FOREIGN PATENT DOCUMENTS

| | | | |
|---|---|---|---|
| 986432 | 3/1951 | France | 52/743 |

*Primary Examiner*—J. Karl Bell

*Attorney, Agent, or Firm*—David B. Harrison

[57] ABSTRACT

A hardwood flooring system formed over a base combines novel milling techniques and an elastomeric filler and sealer material to provide improved resistance to moisture intrusion and resultant damage. Flooring slats are milled so that when assembled in abutting relationship in at least one orientation, a longitudinal gap is thereby defined between adjacent members. This gap may then be filled with a suitable filler/sealer material to provide increased resistance to moisture intrusion. Novel, improved milling geometries for the slats are also disclosed.

37 Claims, 15 Drawing Figures

HARDWOOD FLOORING SYSTEM

BACKGROUND OF THE INVENTION

The present invention relates to flooring systems. More particularly, the present invention relates to hardwood flooring systems which resist damage from moisture, thereby manifesting improved performance and longevity.

Hardwood floors have enjoyed widespread acceptance and use in modern times. Such floors are commonly found in quality houses, auditorium stages, ballrooms, and such floors are essentially utilized for sports arenas for such games as basketball, volleyball, hand ball and squash, where the resilience of the hardwood playing surface is an essential element of the sports activity.

Hardwood floors are usually formed of strips or parquet squares of hardwood which have been precisely milled, so that when the strips or squares are laid down in a desired arrangement, they self-lock together to provide the desired smooth hardwood surface.

One commonly employed locking mechanism has been tongue and groove joinery wherein the hardwood strips and squares have been precisely milled so that opposite sidewalls define tongues and mating grooves.

One of the most devastating hazards facing hardwood floors is damage resulting from moisture. While this problem has been known for many years, little progress has been heretofore realized in achieving a workable solution. Techniques such as use of moisture-resistant impregnation materials, protective coatings, air-flow passages under the floor, vapor barriers, drain channels and the like have become standard practice, with little positive improvement against catastrophic and irreversible damage attributable directly to excessive moisture absorption by the floor.

Wood floors absorb moisture. Such moisture may be the result of surface flooding, or it may be due to condensation in areas of high humidity. Hardwoods absorb water vapor in areas of high humidity, leading directly to buildup of excessive moisture content. Applicant, who has worked in the field of hardwood flooring systems for many years, has discovered that most moisture damage may be attributed to moisture penetration along the unprotected sidewalls of the slats or squares. While varnish coatings protect the top surface, and sleepers elevate the bottom surface, nothing effectively prevents moisture from entering the wood along the sidewalls.

As hardwood absorbs moisture, it expands in volume. Since the hardwood slats and squares tightly abut each other along the side dimensions, the only dimension having freedom of movement is vertical, and the wood tends to buckle to form cups and crowns. Unfortunately, because the floor is so tightly and rigidly constrained in dimensions parallel to the plane of the surface, when the hardwoods expand up or down, the internal fiber structure is destroyed, and the buckling and warpage remain, even after the excessive moisture has been driven out of the wood.

Representative patents illustrative of the prior art approaches and systems which were considered in preparation of this patent include U.S. Pat. Nos. 4,449,342 to Abendroth, 3,713,264 to Morgan, Jr., 3,518,800 to Tank, 2,952,938 to Abrams, 2,862,255 to Nelson, 1,407,679 to Ruthrauff, 1,275,476 to Roy, Re. 26,239 to Rockabrtand et al, and French Pat. No. 417,105.

OBJECTS AND SUMMARY OF THE INVENTION

A general object of the present invention is to reduce and overcome the problem of moisture damage to hardwood flooring systems.

Another object of the present invention is to provide an elastomeric sealing and expansion material in a gap or void especially formed between the adjacent opposed sidewalls of the hardwood members providing the flooring system useful surface, so that the sidewalls are more effectively sealed against moisture penetration and so that if excessive moisture penetrates the members, they will be able to expand in the transverse dimension into the gap area without experiencing irreversible damage to the fiber structure.

One more object of the present invention is to provide a hardwood flooring system and method which overcomes the problems associated with irreversible moisture damage by use of simple milling treatments of the sidewall portions of the slats and squares providing the useful surface of the system and by the use of elastomeric materials which effectively seal the adjacent sidewalls against moisture penetration.

Still one more object of the present invention is to provide hardwood flooring systems which may, through simple milling treatments, be configured with longitudinal gaps filled with elastomeric sealing material to prevent moisture damage, and which may alternatively be configured as a conventional floor without the gaps and sealing material, by reversing the orientation of every other slat during installation of the system.

A hardwood flooring system formed over a base in accordance with the present invention includes a multiplicity of milled hardwood members having substantially uniform cross-sectional geometry, the members being arranged together to form the useful surface of the system. A support grid aligns and supports the members relative to the base. Suitable attachment means such as nails, staples and adhesives secure the members to the support grid. The members are milled so that they define a void along opposed adjacent sidewalls of a shape and volume which corresponds generally to the amount of expansion laterally to be expected from the members upon absorption of a maximum amount of moisture. Each void is filled with a filler-sealer having elastomeric properties, and which is selected to have a bonding affinity with a top coating material used to coat and protect the resultant useful surface.

The method of the present hardwood flooring system invention includes the steps of:

milling a supply of flooring members of hardwood so that they have substantially identical cross-sectional geometry, each member including a top face, a bottom face and sidewalls therebetween, spacing said members upon support means in side-by-side relationship so that substantially uniform voids are defined between each adjacent member, the void dimensions being chosen to correspond to the amount of expansion expected from the adjacent members upon absorption of a maximum amount of moisture, filling the voids with an elastomeric filler-sealer material which effectively contacts and seals the adjacent opposed sidewalls from moisture penetration and which compresses and yields when the adjacent members expand due to absorption of moisture.

These and other objects, advantages and features of the present invention will become more apparent to those skilled in the art upon consideration of the following detailed description of preferred embodiments presented in conjunction with the accompanying drawing.

DETAILED DESCRIPTION OF PREFERRED EMBODIMENTS

Figure 1:
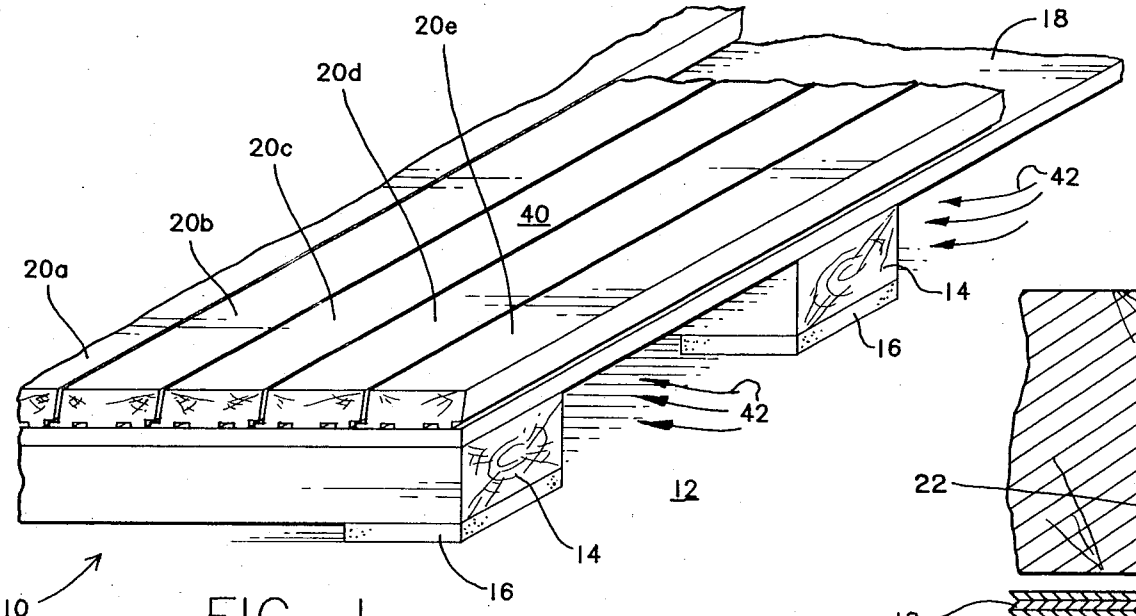
FIG. 1 is a diagrammatic view in perspective of a portion of a flooring system including the principles of the present invention.
Figure 2:
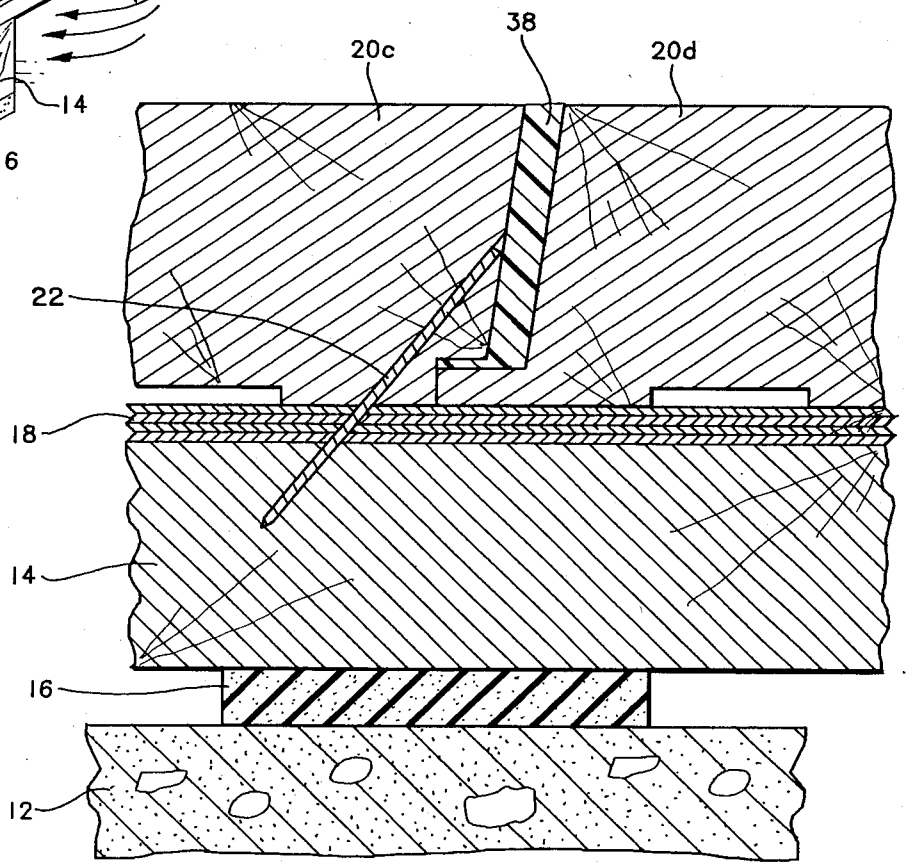
FIG. 2 is an enlarged view in section and elevation of a portion of the flooring system depicted in FIG. 1.
Figure 2A:
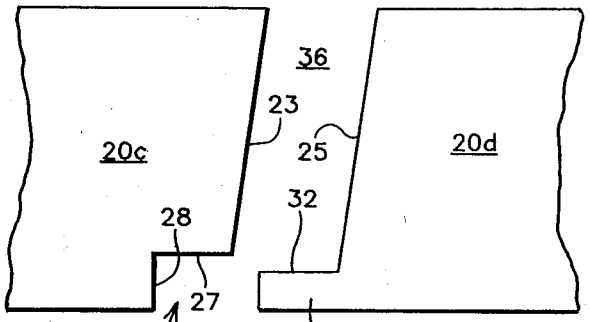
FIG. 2A is a greatly enlarged and exploded view of two flooring slats comprising the system depicted in FIG. 2, illustrating the method of lip and seat joinery which provides a suitable void therebetween for filling with an elastomeric sealing material.

A hardwood flooring system 10 employing the principles of the present invention is depicted as a first preferred embodiment in FIGS. 1, 2 and 2A. Therein, the system 10 is formed over and supported by a base such as a cast concrete slab 12. A vapor barrier film or sheet (not shown) may be interposed between the slab 12 and the system 10 to prevent intrusion of unwanted moisture from below the slab 12.

An array of substantially parallel, spaced apart sleepers 14 forms a supporting gridwork for the flooring system 10. Preferably, the sleepers are of soft wood rails or are metal channels in clip systems or are wood rails surrounded by metal channels. The sleepers 14 are placed apart on twelve inch centers.

Elastomeric pads 16 are placed between each sleeper 14 and the base 12 in a spaced apart relationship, generally about twelve inches apart. Each pad is approximately one half inch thick and has length and width dimensions corresponding to the adjacent surface area of the sleeper 14. The pads 16 are preferably comprised of a closed cell, co-polymer of styrene with a nitrile additive for memory, or equivalent. The additive enables each pad to have an almost complete memory factor which enables the sleepers 14 to conform to minor variations in the contours of the upper surface of the base 12. Collectively, the pads 16 will enable the flooring system 10 resiliently to conform to local variations of loading forces while returning to original contour profile when the load is removed, thereby having a tendency to establish a flat plane for the flooring system 10. The pads 16 will also have an unusual amount of shock absorbency and at the same time contribute significantly to the natural resiliency of the hardwood flooring material comprising the system 10. Parallelism and flatness are promoted by providing a layer 18 of material, such as one half inch thick laminated plywood, CDX grade or better, laid directly on the gridwork of sleepers 14. The plywood sheets comprising the layer 18 are preferably aligned at a bias relative to both the sleepers 14 and elongated slats 20 of hardwood flooring material aligned thereon. The slats 20 are preferably aligned at right angles with respect to the underlying support sleepers 14.

Each slat 20 is secured to a sleeper at each intersection therebetween by suitable fastening means. One such means, illustrated in FIG. 2, is a two inch power-driven nail 22. The nail 22 is driven through a sidewall 23 of the slat **20*c*, through the plywood layer 18 and into the sleeper 14. This manner of attachment secures each of the slats 20 and the underlying plywood layer 18 to the gridwork of sleepers 14**. Other fasteners, such as staples or mastic may be employed with satisfactory results.

The slats 20 are milled to have a substantially uniform cross-sectional geometry. That is to say, each slat includes an undercut sidewall 23 having a lower L-shaped channel defining a seat 24. An opposed sidewall 25 is cut outwardly and ends with a protruding lower lip 26. The seat 24 is defined by a horizontal wall 27 and by a vertical wall 28. The lip 26 is defined by a horizontal wall 32 and an endwall 34. The height of the endwall 34 is slightly less than the height of the vertical wall 28, and the length of the horizontal wall 32 is slightly greater than the depth of the horizontal wall 27. The slat **20*c* is secured to the gridwork of sleepers 14 before the slat 20*d*. After the slat 20*c* has been secured to the sleepers 14, the slat 20*d* is butted up against the slat 26*c*, as shown in FIGS. 1 and 2. The lip 26 slides into the slot 24, and the endwall 34 butts up against the vertical wall 28. This arrangement renders the adjacent slats 20*c* and 20*d* in a slightly spaced apart relation, with a gap 36 being formed between the spaced apart sidewalls 23 and 25**.

The longitudinal gap 36 is sized to correspond to the amount of transverse expansion that would be expected of the adjacent slats **20*c* and 20*d* in the event that they were exposed to and absorbed a predetermined maximum amount of moisture. Each gap 36 is filled with a suitable filling and sealing material. One such material is a co-polymer of urethane. Co-polymers of urethane have been discovered to have excellent adhesive properties with respect to all woods. When gelled in the gaps 36, the co-polymer of urethane seals the sidewall surfaces 23 and 25 and thereby aids in resisting moisture intrusion and absorption into the slats 20. At the same time the urethane filler 38 acts as an adhesive to bind the slats together. Further, the urethane filler 38 gells to an elastomeric state so that it yields in the event that the slats 20** expand due to moisture absorption, thereby preventing buildup of internal forces in the slats which have heretofore led to fiber structure breakdown and consequent irreversible warpage, buckling deformations.

The co-polymer 38 is preferably formulated so that it has appropriate cold flow properties and viscosity enabling it to flow into the gaps 36 when applied over the surface and worked into the gaps with a squeegee or other suitable tool. Alternatively, the material 38 may be injected under pressure into the gap 36 from a suitable pressure dispenser, such as a caulking gun or other suitable, pressurized delivery system. The co-polymer material 38 may be self-polymerizing, or suitable accelerators and other polymerizing techniques may be employed, as may be appropriate to the material selected. For example, some polymer materials are accelerated by radiant energy such as ultraviolet light. Others may have a thermo-setting characteristic and be set by application of e.g. microwave energy. Ideally, the material cold flows easily into the gaps 36 and then is gelled to an elatomeric cured state after excess material has been removed from the surface 40 of the flooring system 10.

The surface 40 is then prepared and finished in accordance with accepted industry procedure. One consideration is that the finishing material should have an affinity for the filler material 36 which is placed in the longitudinal gaps 36. It has been found that accepted finishing materials do have a suitable affinity for the presently preferred co-polymer of urethane filler 36.

Air currents, denoted by the arrows 42, are free to pass between the sleepers 14 and the plywood sheet 18. This free passage of air facilitates maintenance of a desired low moisture content in the flooring system 10. As is known in the art, the sleepers 14 and plywood sheet 18 are kept approximately one inch away from the wall line along the perimeter of the system 10. A perimeter drain tile system (not shown) may be provided along the perimeter to facilitate runoff of any flooding conditions at the surface 40.

Figure 3:
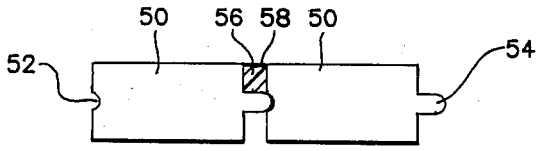
FIG. 3 is a diagrammatic view in end elevation and section of a tongue and groove joinery method incorporating the present invention.

Many variants in cross sectional geometry of the flooring slats may be provided and achieve the principles and advantages of the present invention. For example, in FIG. 3, a conventional tongue and groove joinery between slats 50 is shown. Therein, the groove 52 is undercut relative to the tongue 54, thereby providing the groove 56, filled with elastomeric filler material 58.

Figure 4:
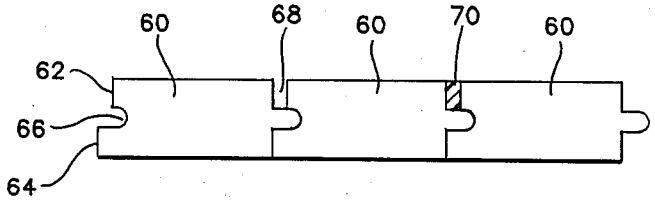
FIG. 4 is a diagrammatic view in end elevation and section of another tongue and groove joinery method following the present invention.

The embodiment shown in FIG. 4 shows conventional tongue and groove slats 60 being modified by the cutting away of an upper part 62 of the sidewall 64 defining the groove 66. The cut-away portion 62 defines a gap 68 into which the filler material 70 is placed in the same manner and for the same reason as discussed in connection with the embodiment of FIGS. 1 and 2.

Figure 5:
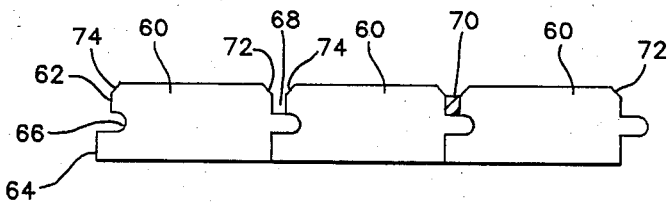
FIG. 5 is a modification of the joinery method depicted in FIG. 4.

In FIG. 5, the embodiment shown in FIG. 4 has been further modified to provide opposed bevels 72 and 74 along the top edges of the gap 68 thereby widening same.

Figure 6:
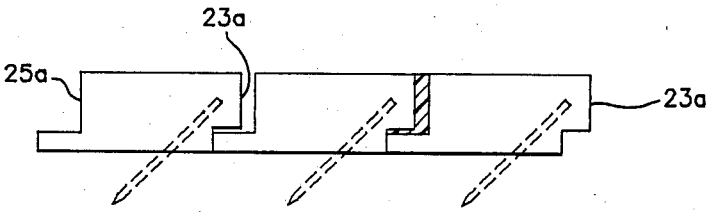
FIG. 6 is a diagrammatic view in end elevation and section of a lip and seat joinery method in accordance with the present invention.

The FIG. 6 embodiment is very similar to the system 10 depicted in FIGS. 1, 2 and 2A, with the variant that the sidewalls **23*a* and 25*a*** are more nearly vertical.

Figure 7:
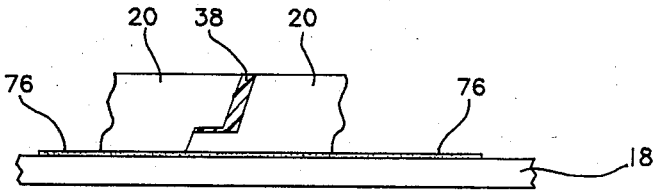
FIG. 7 is a diagrammatic view in end elevation and section of an alternate lip and seat joinery method with undercut sidewalls in accordance with the present invention.

The embodiment depicted in FIG. 7 is similar to the system 10 depicted in FIGS. 1, 2 and 2A with the variant that mastic 76 is applied to adhere the slats 20 to the plywood sheet 18 instead of nails or staples.

Figure 8:
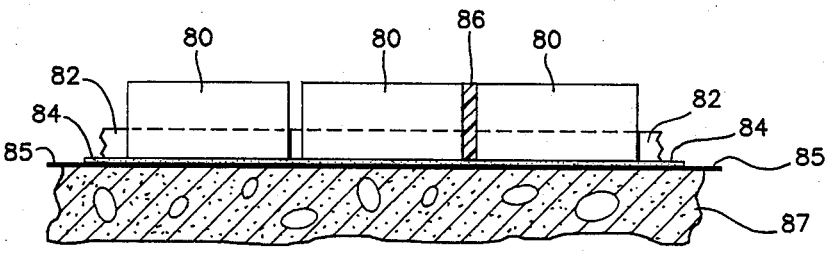
FIG. 8 is a diagrammatic view in end elevation and section of a parquet square joinery method incorporating the principles of the present invention.

FIG. 8 depicts a parquet system in which parquet squares 80 are aligned in a suitable spaced-apart arrangement by a steel spline 82 which lies in a commonly aligned groove through the squares 80. The combination parquet system is then affixed to a base by a suitable mastic adhesive 84 which is separated from e.g. a concrete base slab 87 by a suitable moisture barrier membrane 85. The gaps between the parquet squares are filled with a suitable filler 86 in accordance with the principles of the present invention.

Figure 9:
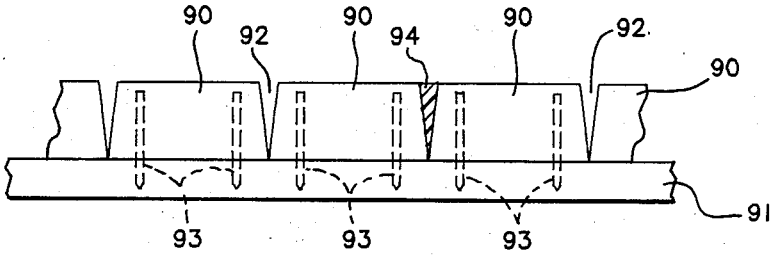
FIG. 9 is a diagrammatic view in end elevation and section of a joinery method following a trapezoid geometry in accordance with the present invention.

FIG. 9 depicts a flooring system in which the slats 90 are milled in a simple trapezoidal cross-section geometry and are then top-nailed into stringers 91 with power driven nails 93 which are countersunk into the top surface of the slats to an appropriate depth and then backfilled with a suitably aesthetic finishing material. Gaps 92 between adjacent slats 90 are filled with a suitable filler 94 in accordance with the principles of the present invention.

Figure 10:
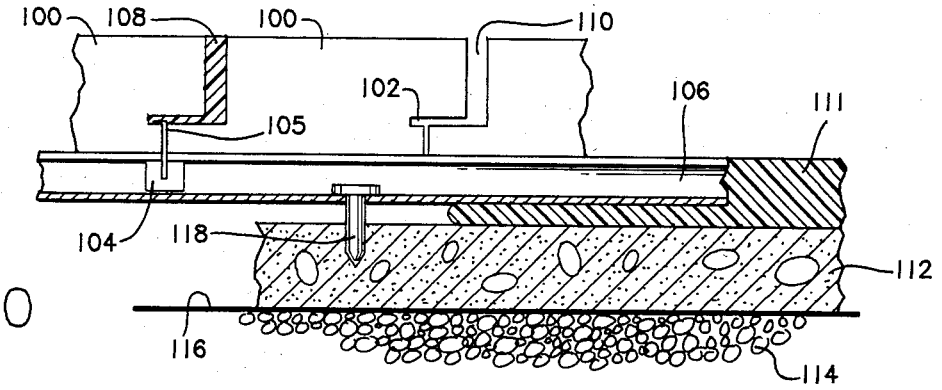
FIG. 10 is a diagrammatic view in end elevation and section of a joinery method employing lip and seat with slots and metal clips for securing the flooring slats to metal channels which incorporates the principles of the present invention.

In FIG. 10, the principles of the present invention are applied to improving a clip system such as the systems depicted in U.S. Pat. Nos. 3,518,800 to Tank, and 3,713,264 to Morgan, Jr., the disclosures of which are hereby expressly incorporated by reference. In FIG. 10 a lip and seat configuration among adjacent slats 100 has been modified to provide a horizontal groove 102 inside the seat. The groove 102 accomodates a metal clip 104 having a reversely pointing tine 105. The clip, when placed in the groove 102 and held there by the adjacent slat, is locked against relative vertical movement by cooperating with inside dimensions of transverse, inwardly flanged U-shaped channels 106. A suitable filler 108 is then emplaced in the gaps 110 between the adjacent slats 100. An underlayment 110 of multicellular, closed cell, flexible polyethylene plastic foam may, for example, be placed between the channels 106 and a concrete base slab 112 supported on a prepared base of crushed and compacted gravel 114. A suitable moisture barrier membrane 116 for waterproofing is placed between the base slab 112 and the compacted gravel 114. Steel anchors 118 are driven into the base slab 112 through the underlayment 110 in order to retain the channels 106 in place. A layer of empregnated fibreboard may be used as underlayment in lieu of the foam 110 with satisfactory results.

Figure 11:
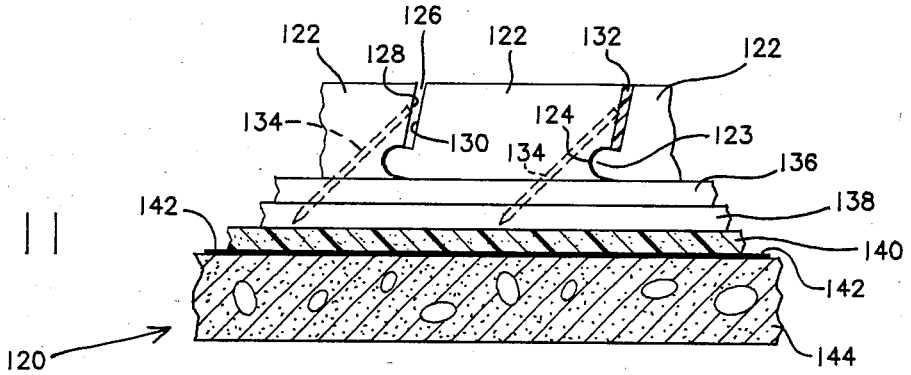
FIG. 11 is a diagrammatic view in end elevation and section of a flooring system following the present invention which is secured directly to a concrete base and is illustrative of yet another joinery method.

In FIG. 11, a flooring system 120 includes milled slats 122 having complementary curved longitudinal grooves 123 and tongues 124 which cooperate to define longitudinal openings 126 between adjacent opposite sidewalls 128, 130. A suitable filler material 132, in accordance with the principles of the present invention is emplaced in the openings 126. Power nails or staples 134 are used to secure the slats 122 to a composite base structure comprising two layers 136, 138 of plywood sheets laid out on opposed bias axes relative to the slats 122 and to each other. The layers 136, 138 are secured to a continuous pad 140 of closed cell styrene foam by a suitable adhesive. The foam pad 140 rests upon a moisture barrier membrane 142 covering a base 144, such as cast concrete. The membrane 142 may, for example, be a continuous two ply, fifteen pound asphalt saturated felt sheet.

Figure 12:
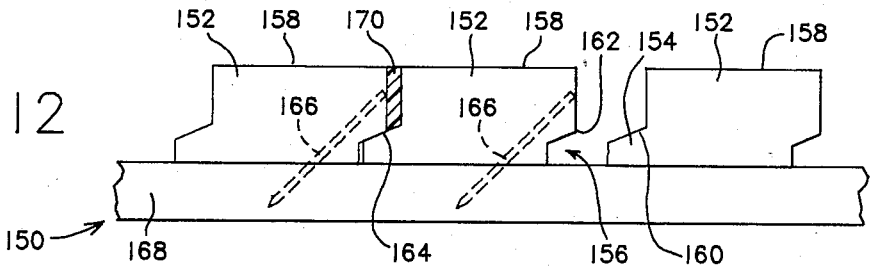
FIG. 12 is a diagrammatic view in end elevation of one more form of joinery which provides automatic levelling of the useful top surface, which is in accordance with the principles of the present invention.

FIG. 12 illustrates yet another preferred embodiment 150 of the present invention. In this system 150, the slats 152 have been milled with flat-surface tongues 154 and grooves 156. The tongues 154 and grooves 156 engage each other in such a way as to create a wedge action which not only properly aligns and facilitates interlocking of the parallel slats 152, but also enables the upper surfaces 158 thereof to be adjusted level and even. Thus, location 160 of the tongue 154 is slightly higher than an upper corner location 162 of the groove 156. When locations 160 and 162 are directly adjacent as at 164, the resultant wedging action thereby brings the top surfaces 158 of the slats 152 into planar alignment. Power nails or staples 166 secure the slats 152 to transverse, spaced apart wooden sleepers 168. When the slats are installed in abutting alignment as at 164, a longitudinal gap is formed which is filled with a suitable elastomeric filler 170 of the type used in the previous preferred embodiments.

Figure 13A:
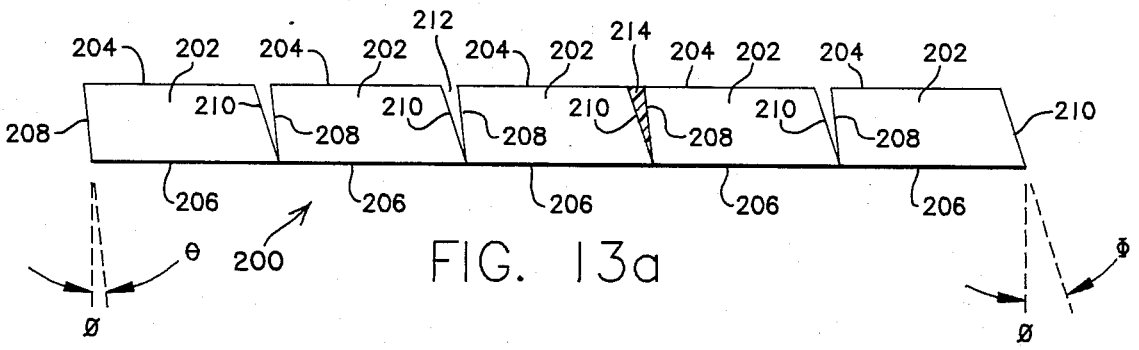
FIGS. 13A and 13B illustrate an alternative form of joinery which may be assembled into two different flooring systems, with the system depicted in FIG. 13A providing longitudinal gaps for elastomeric sealing material, and with the system depicted in FIG. 13B providing for abutting orientation of the slats to achieve a floor system without the longitudinal gaps.

The FIG. 13 system illustrates one more presently preferred embodiment of the present invention. In FIG. 13A, a flooring system 200 comprises an arrangement of parallel slats 202 which have both upper 204 and lower 206 surfaces planed and suitable for providing the useful upper surface. One sidewall 208 is milled with a predetermined first angle theta, such as ten degrees relative to the vertical axis 0. The other sidewall 210 is milled with a predetermined second angle phi, such as fifteen degrees relative to the vertical axis 0. In FIG. 13A, when the salts are arranged symmetrically, a five degree longitudinal gap, denoted by the reference numeral 212, is formed. This gap 212 may then be filled with a suitable elastomeric filler-sealer 214 of the type previously described. The resultant flooring system, constructed upon a suitable base structure (not shown) and finished as previously explained is particularly resistant to moisture intrusion and consequent damage.

Figure 13B:
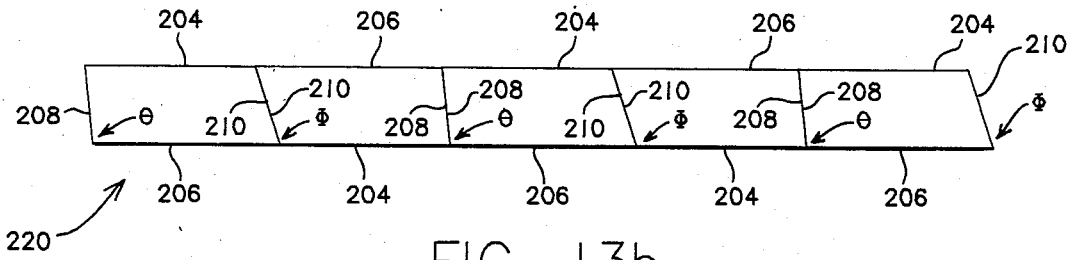

In dry climates, where moisture is not likely to intrude and damage the floor, the same elements 202 may be arranged as shown in FIG. 13B to achieve a more conventional flooring system 220 which does not provide for any longitudinal gaps 212. In this system 220 every other slat is reversed, so that its bottom surface 206 is on top and is aligned with the top surfaces 204 of the adjacent two slats. Complementarily angled sidewalls (208—208 and 210—210) are then adjacently opposed, and when the slats 202 are so arranged the gaps 212 are thereby eliminated.

To those skilled in the art to which this invention pertains many changes in construction and widely varying embodiments and applications will suggest themselves without departing from the spirit and scope of the invention. The disclosure and the description herein are purely illustrative and are not intended to be in any sense limiting.

I claim:

1. A method of constructing a hardwood flooring system upon a base, said method comprising the steps of:

milling a supply of flooring members of hardwood so that they have substantially identical cross-sectional geometry, each member including a top face, a bottom face and sidewalls therebetween, spacing said members upon support means supported by said base, and attaching said members to said support means, said members being aligned in side-by-side relationship so that substantially uniform voids in an upper major surface of said system are thereby defined by and between adjacent opposed sidewalls of adjacent members, the void dimensions being chosen to correspond to the amount of transverse expansion to be expected by the adjacent members upon absorption of moisture, after said members have been attached to said support means, filling said voids by flowing an initially flowable, curable elastomeric filler-sealer material into said voids which thereupon effectively contacts and seals said adjacent opposed sidewalls from moisture penetration and which when cured compressibly yields when adjacent members expand due to absorption of moisture.

2. The construction method set forth in claim 1 wherein said milling step comprises the additional step of forming spacing means on said sidewalls for cooperating to provide self-alignment of said members when placed in side-by-side relationship thereby rendering more uniform the geometry of said voids.

3. The construction method set forth in claim 2 wherein said forming step includes the step of forming interlocking means for aiding in securing said members to said support means.

4. The construction method set forth in claim 3 wherein said forming step includes the step of forming said interlocking means integrally with said spacing means.

5. The construction method set forth in claim 4 wherein said forming step comprises forming said interlocking means as to cause wedging between said members to facilitate planar alignment of said top faces thereof.

6. The construction method set forth in claim 1 wherein said filling step comprises the step of filling said voids with an uncured fluid resin co-polymer and causing said co-polymer to become cured after it has filled said voids.

7. The construction method set forth in claim 5 wherein said filling step comprises filling said voids with an uncured co-polymer of urethane.

8. The construction method set forth in claim 1 wherein said filling step comprises the step of placing filler-sealer in each void and then curing said filler-sealer by exposure to radiant energy.

9. The construction method set forth in claim 8 wherein said filler-sealer comprises a co-polymer resin which polymerizes upon exposure to ultra-violet light energy and wherein said radiant energy comprises ultra-violet light energy.

10. The construction method set forth in claim 1 wherein said spacing step comprises spacing said members upon an array of generally parallel, spaced apart sleepers arranged generally perpendicular to the longitudinal axis of said members.

11. The construction method set forth in claim 10 wherein said spacing step includes the step of placing a support sheet between said members and said sleepers and securing said members to said sleepers with attachment means which pass through and thereby secure said sheet.

12. The construction method set forth in claim 10 further comprising the step of placing elastomeric pads in spaced apart relation between said sleepers and said base, said pads comprising a closed cell co-polymer foam to which a memory enhancing agent has been added.

13. The construction method set forth in claim 12 wherein said closed cell co-polymer comprises a co-polymer of styrene and said memory enhancing agent comprises a nitrile compound.

14. The construction method set forth in claim 1 comprising the step of forming said support means on said base as at least one continuous layer of material having resiliency to shock.

15. The construction method set forth in claim 14 wherein said step of forming said support means comprises the step of forming said support means as a plurality of continuous layers of material, at least one of said layers comprising a closed cell polymer foam.

16. The construction method set forth in claim 1 wherein said sidewalls of said members are milled to different angles, so that said members may be assembled in one arrangement to define said voids and so that said members may be assembled in another arrangement in which said voids are not present.

17. A hardwood floor system defining a useful surface formed over a base and comprising:

a multiplicity of milled hardwood flooring members of substantially uniform height and width dimensions, said members being arranged together to define said useful surface, support means on which said members are supported, aligned, and attached, said support means being supported by said base, attachment means for attaching said members to said support means, voids in an upper major surface of said system being defined along opposed adjacent sidewalls of said members when arranged and attached to define said useful surface, said voids being sized and shaped to accomodate transverse expansion of said members resulting from absorption of moisture, initially flowable, curable filler-sealer means disposed in said voids by flow after said members have been attached to said support means, followed by cure to a permanent, elastomeric state for filling same and for sealing said adjacent opposed sidewalls against moisture intrusion, said filler-sealer means compressibly yielding in response to transverse expansion of said members due to moisture absorption.

18. The hardwood floor system set forth in claim 17 wherein said filler-sealer means comprises a co-polymer of urethane.

19. The hardwood floor system set forth in claim 17 wherein said support means comprises an array of generally parallel, spaced apart sleepers aligned generally perpendicular to the longitudinal axes of said members.

20. The hardwood floor system set forth in claim 19 further comprising elastomeric cushion pads placed between said sleepers and said base, said pads comprising a closed cell foamed co-polymer to which a memory enhancing agent has been added.

21. The hardwood floor system set forth in claim 20 wherein said pads comprise a closed cell foamed co-polymer of styrene to which a nitrile compound has been added as said memory enhancing agent.

22. The hardwood floor system set forth in claim 19 further comprising a support sheet layer between said members and said sleepers and wherein said attachment means comprises fasteners engaging said members, said sheet layer and said sleepers.

23. The hardwood floor system set forth in claim 22 wherein said sheet layer comprises an array of plywood sheets arranged on a bias angle with respect to said sleepers and with respect to said members.

24. The hardwood floor system set forth in claim 17 wherein said support means comprising a plurality of continuous support sheet layers laid directly upon said base.

25. The hardwood floor system set forth in claim 24 wherein one of said support sheet layers comprises a closed cell polymer foam of predetermined thickness to provide resiliency to said floor system.

26. The hardwood floor system set forth in claim 17 wherein said hardwood members are milled so that opposite sidewalls define mating tongues and grooves and act to space said sidewalls apart thereby defining said voids.

27. The hardwood floor system set forth in claim 26 wherein said hardwood members are milled so that upper adjacent edge areas of said opposed sidewalls are bevelled.

28. The hardwood floor system set forth in claim 17 wherein each said hardwood member is milled so as to define a longitudinal recess along a lower longitudinal edge of one sidewall and a protruding lip formed along an opposite other sidewall, said lip being sized and placed to engage a recess of an adjacently placed member thereby aiding in securing it in intended alignment, said lip and recess arrangement further acting to space said members apart so as to define said void therebetween.

29. The hardwood floor system set forth in claim 17 wherein each said hardwood member is milled so as to define an undercut first sidewall and a protruding second sidewall opposite the first sidewall so that a protruding second sidewall of an adjacent member engages said undercut first sidewall thereby aiding in securing said adjacent member, said undercut first sidewall and said protruding second sidewall of said adjacent member acting to space said members apart so as to define said void therebetween.

30. The hardwood floor system set forth in claim 17 wherein said uniform cross-sectional geometry of said members comprises a trapezoid, so that when said members are arranged together to form said useful surface, said voids are substantially Vee-shaped in cross-section geometry.

31. The hardwood floor system set forth in claim 17 wherein said attachment means comprises an array of spaced apart spline strips aligned generally transverse to said members and having engagement tines for engaging said members, and wherein said support means includes a resilient curable mastic material placed between said strips and said base.

32. The hardwood floor system set forth in claim 17 wherein said hardwood members are formed and arranged to define parquetry.

33. The hardwood floor system set forth in claim 28 wherein said members are milled to define a longitudinal slot opening on a vertical face in said recess, wherein said support means comprises an array of spaced apart formed metal channels, and wherein said attachment means comprises clips, each being adapted to lockingly engage said member at said slot and simultaneously lockingly engage said channel.

34. The hardwood floor system set forth in claim 28 wherein said members are milled to so as to cause wedging between said members to facilitate planar alignment of said top faces thereof wherein the relative spacing between members is used to adjust and control planar alignment of said top faces.

35. The hardwood floor system set forth in claim 30 wherein one sidewall of a member forms a first predetermined angle with respect to a vertical reference and the other sidewall of said member forms a second predetermined angle with respect to said vertical reference different than said first angle, so that when said members are assembled in one arrangement said voids are defined, and when said members are assembled in another arrangement no void is defined.

36. A hardwood floor system defining a useful surface formed over a base and comprising:

a multiplicity of milled hardwood flooring members of substantially uniform height and width dimensions, said members being arranged together to define said useful surface, each said hardwood member being milled so as to define a longitudinal recess along a lower longitudinal edge of one sidewall and a protruding lip formed along an opposite other sidewall, said lip being sized and placed to engage a recess of an adjacently placed member thereby aiding in securing it in intended alignment, each said member being further milled to so as to cause wedging between said members to facilitate planar alignment of said top faces thereof wherein the relative spacing between members is used to adjust and control planar alignment of said top faces, support means on which said members are supported and aligned, said support means being supported by said base, and attachment means for attaching said members to said support means.

37. A plurality of milled flooring slats having a common crosssectional geometry, each said slat having a planed flat top surface, a planed flat bottom surface substantially parallel with said top surface and two opposite, substantially planar sidewalls, a first sidewall being milled to define a first angle relative to a vertical reference axis and a second sidewall milled to define a second angle relative to said vertical axis wherein said second angle is different from said first angle; and the difference between said second angle and said first angle defining a longitudinal gap between a plurality of said slats aligned in a first abutting arrangement in which a first sidewall of one slat oppositely faces a second sidewall of an adjacent slat, and wherein a plurality of said slats may be aligned in a second abutting arrangement in which a first sidewall of one slat oppositely faces a first sidewall of an adjacent second slat, and a second sidewall of the one slat oppositely faces a second sidewall of an adjacent third slat wherein there is no resultant longitudinal gaps formed between the first, second and third slats.

* * * * *